US007080830B2

(12) United States Patent
Suzuki et al.

(10) Patent No.: US 7,080,830 B2
(45) Date of Patent: Jul. 25, 2006

(54) SHEET PROCESSING APPARATUS WITH MULTIPLE CONVEYING UNITS

(75) Inventors: Toshimasa Suzuki, Chiba (JP); Wataru Kawata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/376,290

(22) Filed: Mar. 3, 2003

(65) Prior Publication Data

US 2003/0168796 A1 Sep. 11, 2003

(30) Foreign Application Priority Data

Mar. 7, 2002 (JP) ..... 2002-062549

(51) Int. Cl.
*B65H 37/04* (2006.01)

(52) U.S. Cl. ..... 270/58.08; 270/58.31; 270/58.23; 270/58.01; 399/110

(58) Field of Classification Search ..... 270/1.01, 270/1.02, 58.31, 58.23, 58.29, 58.01, 52.01, 270/52.18, 58.07, 58.08, 52.16; 399/110
See application file for complete search history.

(56) References Cited

U.S. PATENT DOCUMENTS

| | | | | |
|---|---|---|---|---|
| 4,177,979 | A * | 12/1979 | Orsinger et al. | 270/52.16 |
| 4,517,650 | A * | 5/1985 | Gomes et al. | 700/221 |
| 4,989,852 | A * | 2/1991 | Gunther, Jr. | 270/56 |
| 5,272,511 | A * | 12/1993 | Conrad et al. | 399/382 |
| 5,348,283 | A | 9/1994 | Yanagi et al. | 271/127 |
| 5,489,969 | A | 2/1996 | Soler et al. | 355/207 |
| 5,580,042 | A | 12/1996 | Taniguro et al. | 271/274 |
| 5,592,280 | A | 1/1997 | Ishizuka et al. | 399/410 |
| 5,592,881 | A * | 1/1997 | Rabjohns | 101/483 |
| 5,620,174 | A | 4/1997 | Taniguro et al. | 271/10.12 |
| 5,648,808 | A | 7/1997 | Yanagi et al. | 347/104 |
| 5,655,759 | A * | 8/1997 | Perkins et al. | 270/52.02 |
| 5,672,019 | A | 9/1997 | Hiramatsu et al. | 400/624 |
| 5,695,181 | A * | 12/1997 | Yamanaka | 270/58.08 |
| 5,725,319 | A | 3/1998 | Saito et al. | 400/629 |
| 5,752,154 | A * | 5/1998 | Maruyama et al. | 399/407 |
| 5,810,346 | A * | 9/1998 | Jorg | 270/59 |
| 5,862,754 | A * | 1/1999 | Hill et al. | 101/228 |
| 5,911,414 | A | 6/1999 | Kato et al. | 270/58.07 |
| 6,226,475 | B1 * | 5/2001 | Kabumoto et al. | 399/107 |
| 6,237,910 | B1 | 5/2001 | Kawata | 271/213 |
| 6,264,189 | B1 | 7/2001 | Kawata | 271/176 |
| 6,389,249 | B1 * | 5/2002 | Kabumoto et al. | 399/107 |
| 6,505,829 | B1 | 1/2003 | Kawata | 271/208 |
| 6,616,135 | B1 * | 9/2003 | Shida et al. | 270/58.08 |
| 2003/0026633 | A1 | 2/2003 | Nakagawa et al. | 399/367 |

FOREIGN PATENT DOCUMENTS

| | | |
|---|---|---|
| JP | 8-282902 | 10/1996 |

* cited by examiner

*Primary Examiner*—Patrick Mackey
(74) *Attorney, Agent, or Firm*—Fitzpatrick, Cella, Harper & Scinto

(57) ABSTRACT

The invention provides a sheet processing apparatus including a sheet processing portion for processing a sheet, and a sheet conveying portion for conveying a sheet to the sheet processing portion, wherein the sheet conveying portion includes a sheet conveying unit having a sheet intake port, a sheet discharge port, and a linear sheet conveying path for conveying the sheet from the sheet intake port to the sheet discharge port, and a plurality of sheet conveying units are disposed in parallel such that respective sheet conveying paths thereof are positioned on the substantially same plane and in a rearrangeable fashion.

16 Claims, 9 Drawing Sheets

SHEET PROCESSING APPARATUS WITH MULTIPLE CONVEYING UNITS

BACKGROUND OF THE INVENTION

1. Field of the Invention

The present invention relates to a sheet processing apparatus for performing various types of processing to sheets, such as sorting sheets, and binding the sheets for bookbinding. In particular, the present invention relates to the structure of a sheet conveying portion for conveying the sheets to a sheet processing portion.

2. Related Background Art

Conventionally, examples of a sheet processing apparatus include one structured so as to be capable of implementing processes such as sorting and bookbinding with respect to sheets on which images are formed by an image forming portion for forming images by electrophotography or the like, at high speed and in large quantities. An example of this type of sheet processing apparatus is the one disclosed in Japanese Patent Application Laid-open No. 08-282902.

FIG. 9 is a diagram showing the structure of this type of sheet processing apparatus. In the same figure, reference symbol 1A denotes an image forming portion provided with a photosensitive belt 98, a developing apparatus 104, and the like, reference numeral 4 denotes a sheet feeding apparatus disposed in parallel with the image forming portion 1A and provided with plural sheet receiving portions 2 (2*a* to 2*e*) and a separating portion 3, and reference numeral 5 denotes a sheet processing portion that performs sheet sorting, bookbinding, and the like.

In a sheet processing apparatus having this type of structure, a large volume of image forming jobs can be performed at one time by setting sheets used for bookbinding in each of the sheet receiving portions 2 (2*a* to 2*e*). It thus becomes possible to perform economy bookbinding operations in large volume and at high speed.

As shown in the same figure, paths P1 to P4 for conveying sheets to the image forming portion 1A are provided between the image forming portion 1A and four sheet receiving portions 2*a*, 2*b*, 2*c*, and 2*e*, respectively. Sheet types necessary for performing bookbinding of one book can thus be received respectively and separately in each of the sheet receiving portions 2*a*, 2*b*, 2*c*, and 2*e*.

As a result, for cases in which thick paper is used for a front cover and a back cover, or when colored paper or tabbed paper is used to sort the contents, for example, bookbinding of a sheet bundle in which the front cover and back cover are thick and the contents are sorted with colored paper or tabbed paper can be performed provided that plain paper, thick paper, colored paper, and tabbed paper are received in the sheet receiving portions 2*a*, 2*b*, 2*c*, and 2*e*, respectively, the sheets to be used are selected in advance, and the sheets are conveyed in order to the image forming portion 1A.

Further, for cases in which a large volume of identical types of sheets are used, provided that the sheets which are to be used in large quantity are set in plural sheet receiving portions, then even if the sheets in one of the sheet receiving portions are all gone, feeding continues from other of the sheet receiving portions, and the sheets can be replenished during that period. Thus, bookbinding operations can be performed continuously without stopping the system.

Further, with the example shown in FIG. 9, paths P5 and P6 are provided in the two sheet receiving portions 2*c* and 2*d*, through which the sheets are conveyed to the sheet processing portion 5 without passing through the image forming portion 1A. Thus, the sheets that are received in the two sheet receiving portions 2*c* and 2*d* can be conveyed to the sheet processing portion 5 through the paths P5 and P6 without passing through the image forming portion 1A. Note that the sheet receiving portions 2*c* and 2*d*, in which the sheets that do not require image formation are thus received, are hereinafter also referred to as inserters.

For cases in which, for example, the image forming portion 1A is an apparatus dedicated to black and white printing, and one wants to insert color printed sheets in between sheet bundles, or for cases in which the sheets are special sheets that are weak with respect to heat and cannot be made to pass through the image forming portion 1A, the sheets flow in confluence to a path P7 provided between the image forming portion 1A and the sheet processing portion 5, and are conveyed to the sheet processing portion 5 as they are.

Note that a center bookbinding machine provided with a stapler which performs processes from stapling to folding online, a threadless bookbinding machine that glues a back cover onto an aligned sheet bundle, an offset stacker that performs only sorting and aligning and in which bookbinding operations are performed offline, and the like exist as the sheet processing portion 5 provided in this type of sheet processing apparatus. These are used in accordance with the type of processing.

However, conventional sheet processing apparatuses capable of performing these types of economy bookbinding operations in large quantity and at high speed are used in a variety of manners. Desires regarding the type and quantity of the sheets used, the manner of processing, the loading capacity, and the like differ among the users.

For example, in the sheet processing apparatus shown in FIG. 9, the number of the sheet types that can be subjected to bookbinding is limited to four. When a greater number of sheet types are to be used, work becomes necessary for dividing a job into several divisions, and collating them again by using a collator or the like after output. Further, along with increases in color printing speeds, it has been becoming more common recently to insert color printed sheets even in economy bookbinding, and there is also a demand for increasing the number of stages of the inserter for multi-stage construction.

However, it is difficult to perform extension of only the sheet feeding apparatus 4 in a sheet processing apparatus like that of FIG. 9, and it is difficult to respond to the aforementioned demands. Further, it is also difficult to perform extension or exchange of the sheet processing portion according to the load capacity, type of processing, and the like. Therefore, the expandability of the conventional sheet processing apparatus is poor.

SUMMARY OF THE INVENTION

The present invention has been made in view of the above circumstances, and therefore an object of the present invention is to provide a sheet processing apparatus having high expandability regarding the types and volumes of sheets used, and further, in terms of the processing manner, the load capacity, and the like.

According to an aspect of the present invention, a sheet processing apparatus includes: a sheet processing portion for processing a sheet; and a sheet conveying portion for conveying a sheet to the sheet processing portion, in which: the sheet conveying portion comprises a sheet conveying unit having a sheet intake port, a sheet discharge port, and a linear sheet conveying path for conveying the sheet from the sheet intake port to the sheet discharge port; and a plurality of sheet conveying units are disposed in parallel such that respective sheet conveying paths thereof are positioned on the substantially same plane and in a rearrangeable fashion.

According to another aspect of the present invention, a sheet processing apparatus includes: a plurality of sheet conveying units having the same structure, each having a sheet intake port, a sheet discharge port, and a linear sheet conveying path for conveying a sheet from the sheet intake port to the sheet discharge port, the sheet conveying units being arranged in parallel such that the respective sheet conveying paths are positioned on the substantially same horizontal plane and in a rearrangeable fashion, in which a sheet feeding unit for supplying a sheet is detachably mounted in each of the sheet conveying units disposed on the upstream side, and a sheet processing unit is detachably mounted to each of the sheet conveying units disposed on the downstream side, among the respective sheet conveying units.

DESCRIPTION OF THE PREFERRED EMBODIMENTS

Embodiments of the present invention will be explained in detail below using the accompanying drawings.

Figure 1:
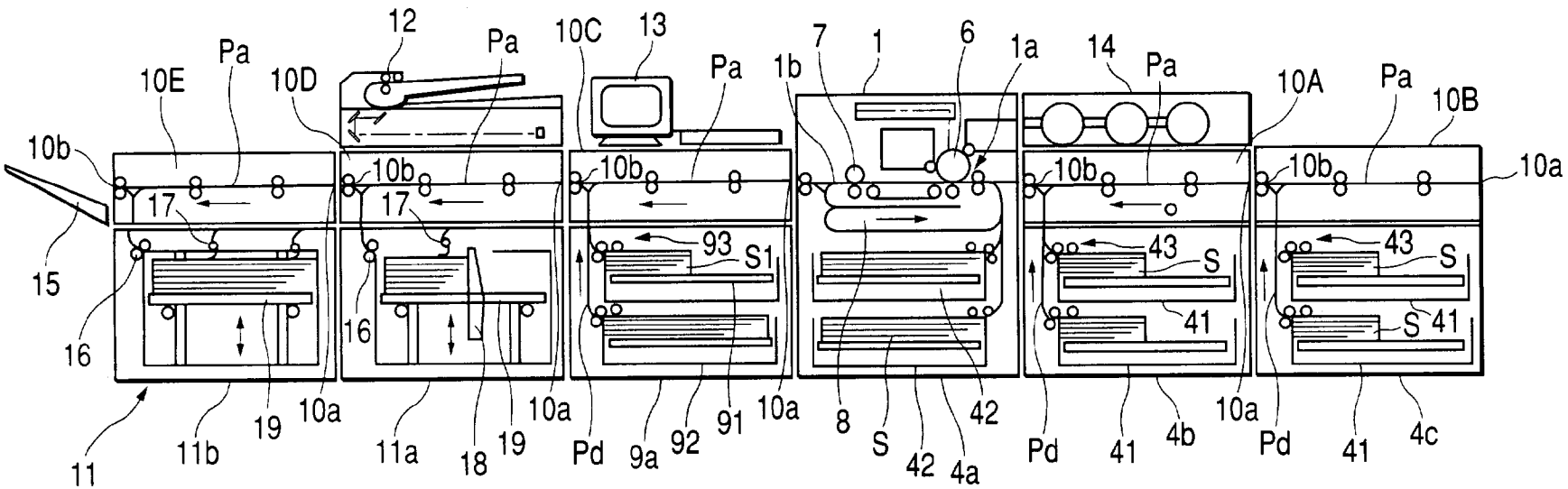
FIG. 1 is a view showing an overall structure of a sheet processing apparatus according to a first embodiment of the present invention.

FIG. 1 is a diagram showing an overall structure of a sheet processing apparatus according to a first embodiment of the present invention.

In the figure, reference numeral 1 denotes an image forming portion. A sheet feeding apparatus 4*a* that feeds sheets S, which are received in sheet receiving portions 42 and 42, such as sheet feeding cassettes, to an image forming means la structured by a photosensitive drum 6 and the like is disposed in a lower portion of the image forming portion 1. An image formed on the photosensitive drum 6 is transferred on the sheet S fed by the sheet feeding apparatus 4*a*, and when the sheet passes through a fixing apparatus, the transferred image is fixed onto the sheet S. As a result, the image is formed on the sheet.

Further, for cases in which an image is also formed on a back surface of the sheet S, the sheet S on which the image is formed on the front surface is switched back in a reversing path 8, and then fed again toward the photosensitive drum 6.

Note that reference symbol 1*b* denotes a linear sheet conveying path for discharging the sheet S after being fed to the image forming means 1*a*. The sheet S that has been fed by the sheet feeding apparatus 4*a* is discharged toward the image forming means 1*a* along the sheet conveying path 1*b*, and after image formation, is discharged toward a sheet processing portion 11 discussed later.

Reference symbols 10A and 10B denote plural identical sheet conveying units (two in this embodiment) which structure a sheet conveying portion for conveying sheets and which are provided upstream of the image forming portion 1. The sheet conveying units 10A and 10B each have a sheet intake port 10*a*, a sheet discharge port 10*b*, and a linear sheet conveying path extending in a nearly horizontal direction for conveying the sheet S from the sheet intake port 10*a* to the sheet discharge port 10*b*.

Further, sheet feeding units 4*b* and 4*c*, each of which is provided with sheet receiving portions 41 and 41, such as sheet feeding cassettes, and a sheet feeding portion 43 for separating the sheets one by one from each of the sheet receiving portions 41 and 41 and sending them onward, are attachably and detachably disposed below the sheet conveying units 10A and 10B, respectively. Note that reference symbols Pd denote conveying paths provided in the sheet feeding units 4*b* and 4*c*, for making the sheets received in each of the sheet receiving portions 41 and 41 join together in a sheet conveying path Pa.

With the above-described structure, the sheets received in the sheet receiving portions 41 and 41 pass through the conveying path Pd and are conveyed to the sheet conveying path Pa, and then conveyed one after another to the image forming portion 1 via the sheet conveying path Pa.

Reference symbols 10C, 10D, and 10E denote plural sheet conveying units (three in this embodiment) provided downstream of the image forming portion 1 in the sheet conveying direction. The sheet conveying units 10C, 10D, and 10E are similar to the sheet conveying units 10A and 10B already discussed, and each have the sheet intake port 10*a*, the sheet discharge port 10*b*, and the linear sheet conveying path Pa extending in a nearly horizontal direction for conveying the sheets form the sheet intake port 10*a* to the sheet discharge port 10*b*. The sheet conveying units 10A, 10B, 10C, 10D, and 10E have the same structure, and are disposed in parallel in a rearrangeable fashion.

Disposed below the sheet conveying unit 10C closest to the image forming portion 1 is a sheet feeding unit 9*a* provided with sheet receiving portions 91 and 92, such as sheet feeding cassettes, in which sheets S1 that do not need image formation with the image forming portion 1 are set, and a sheet feeding portion 93 for separating the sheets one by one from each of the sheet supplying portions 91 and 92 and sending them onward.

Note that the reference symbol Pd denotes the conveying path, which is provided in the sheet feeding unit 9*a*, for making the sheets S1 received in the sheet receiving portions 91 and 92 join together in the sheet conveying path Pa. The sheet feeding unit 9*a* has an inserting function for supplying covers, photographs inserted between sheet bundles, and the like in performing bookbinding and the like of the sheets on which images have been formed.

Further, offset stackers 11*a* and 11*b*, which structure the sheet processing portion 11 that offsets and loads sheet bundles by bundle after performing sheet bundle alignment and separation and each of which is provided with a loading container 19, a paddle apparatus 17, and the like, are disposed below the sheet conveying units 10D and 10E placed downstream of the sheet conveying unit 10C.

With the above-described structure, the sheets S1, which do not require image formation and which are received in the sheet receiving portions 91 and 92 of the sheet feeding unit (inserter) 9*a*, pass through the conveying path Pd and are conveyed to the sheet conveying path Pa. Via the sheet conveying path Pa, the sheets S1 are inserted, for example, between the sheets S that have passed through the image forming portion 1 and on which images have been formed, and then conveyed to the offset stackers 11*a* and 11*b*.

Note that the sheets S and S1 are first discharged from an inlet roller 16 onto the loading container 19 in the offset stackers 11*a* and 11*b*, and then aligned by being bumped against a bumping plate 18 by the paddle apparatus 17. After that, the sheets S and S1 are subjected to offsetting, sorting, and aligning with an aligning member not shown in the figure. Note that the loading container 19 gradually falls lower as loading progresses and that after loaded to capacity, the loading container 19 can be pulled out to a front side and the sheets are conveyed to the next process.

Further, in the figure, reference numeral 12 denotes an image reading apparatus, reference numeral 13 denotes a display portion provided with an operating portion and the like, and reference numeral 14 denotes a toner supply hopper for responding to large-capacity continuous image formation. The image reading apparatus 12, the display portion 13, and the hopper 14 are disposed on an upper surface of a sheet conveying apparatus 10.

Space saving can be achieved by disposing the image reading apparatus 12, the display portion 13, and the hopper 14, which are means necessary for image formation with the image forming portion 1, on the sheet conveying apparatus, as described above. Note that reference numeral 15 denotes a sheet loading portion that receives sheets discharged without being treated by the sheet processing portion 11. Note also that the image forming means 1*a* may also be unitized and disposed below the sheet conveying unit.

With the embodiment shown in the figure and already discussed, a total of six sheet receiving portions 41 and 42, provided in two to each of the sheet feeding apparatus 4*a* and the sheet feeding units 4*b* and 4*c*, are prepared as sheet receiving portions for image formation. Further, two stages of the sheet receiving portions 91 and 92, which are provided to the sheet feeding unit (inserter) 9*a*, are prepared as sheet receiving portions used for the sheets which do not require image formation.

Diversification in the thickness, color, and type of the sheets S and S1 can thus be handled by providing a large number of the sheet receiving portions 41, 42, 91, and 92.

Further, the two large capacity offset stackers 11*a* and 11*b* are coupled to constitute the sheet processing portion 11. Thus, if the offset stacker 11*a* on the upstream side reaches a fully loaded state, for example, then the job can be automatically handed over to the offset stacker 11*b* on the downstream side. It thus becomes possible to perform sheet bundle unloading from the offset stacker 11*a* on the upstream side without stopping the job.

Note that for cases in which image formation is performed from a leading page, the sheets S, which have undergone image formation on their upper surfaces in the image forming portion 1, are then automatically loaded in page order, with the image surface pointing downward, by the offset stackers 11*a* and 11*b* in this embodiment. Therefore, it is not necessary to perform sheet reversal for each sheet.

The sheet conveying units 10A to 10E have the same structure in this embodiment. Therefore, the sheet conveying units 10A to 10E having the same structure are disposed in parallel on the upstream and downstream sides of the image forming portion 1 such that the sheet conveying paths Pa respectively provided in the sheet conveying units 10A to 10E and the sheet conveying path 1*b* provided in the image forming portion 1 at the same level. As a result, the sheet conveying paths Pa provided in the respective sheet conveying units 10A to 10E and the sheet conveying path 1*b* provided in the image forming portion 1 form a substantially flat sheet conveying path.

The sheet conveying units 10A to 10E and the image forming portion 1 are disposed in parallel such that the sheet conveying paths Pa and 1*b* form the substantially flat sheet conveying path, and in other words, such that the sheet conveying paths Pa of the sheet conveying units 10A to 10E and the sheet conveying path 1*b* provided in the image forming portion 1 are positioned on the same plane. Therefore, conveying property can be improved, and jams in the sheets S and S1 can be prevented from developing when the sheets pass through the sheet conveying paths Pa and 1*b*. As a result, downtime can be reduced.

Further, the sheet conveying units 10A to 10E are made to have the same structure. Therefore, the flat shape sheet conveying path can be formed at all times even in cases of rearranging the sheet conveying units 10A to 10E or increasing or decreasing the number of units.

Figure 2:
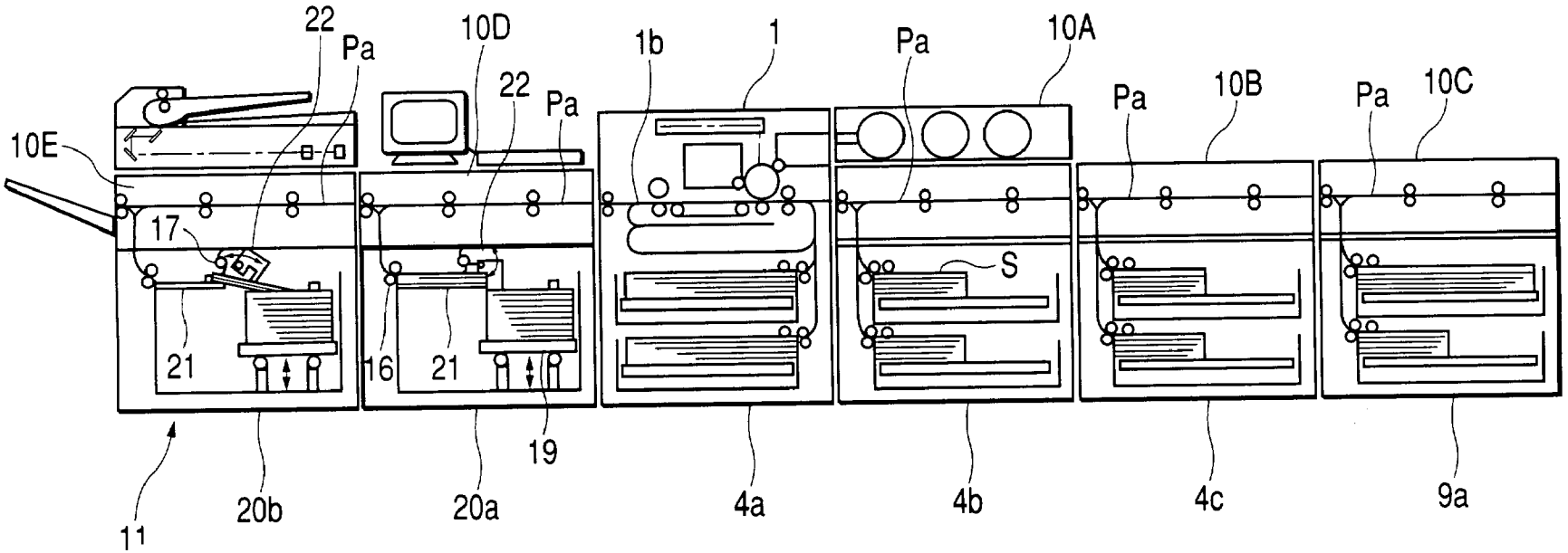
FIG. 2 is a view showing another structure of the sheet processing apparatus.

A job for inserting the sheets S1 thus becomes unnecessary, for example. In addition, for cases in which it is necessary to increase the sheet feeding capacity or the number of feeding stages in performing image formation, the sheet feeding capacity or the number of feeding stages for image formation can be increased while forming the flat shape sheet conveying path if the sheet feeding unit (inserter) apparatus 9*a* is moved to the right edge together with the sheet conveying unit 10C, as shown in FIG. 2.

That is, it becomes possible to increase the sheet feeding capacity or the number of feeding stages for image formation only by moving the sheet conveying unit 10C and the sheet feeding unit 9*a*. Of course, changes are easily made for the opposite case as well. For example, for jobs that require a lot of color sheet insertions, the sheet conveying unit 10B and the sheet feeding unit 4*c* may be disposed between the image forming portion 1 and the sheet feeding unit (inserter) apparatus 9*a*.

For cases in which the sheet conveying portion for conveying the sheets S to the sheet processing portion 11 is structured by a predetermined number of, for example, the sheet conveying units 10A and 10B on the upstream side of the image forming portion 1 and the sheet conveying units 10C, 10D, and 10E on the downstream side of the image forming portion 1 as shown in FIG. 1, and also, the sheet feeding capacity or the number of feeding stages is increased, the expandability in the feeding capacity or the number of feeding stages can be enhanced by arranging the sheet conveying unit 10C and the sheet feeding unit 9*a* attached to the sheet conveying unit 10C as one member. In addition, reduction in manufacturing cost can be achieved with component commonality.

Note that the number of sheet conveying units provided with the sheet feeding units can be increased for cases in which the feeding capacity or the number of feeding stages needs to be further increased. The sheet conveying units have identical structures here, and therefore the flat shape sheet conveying path can be formed even if the number of the sheet conveying units is increased.

Reference symbols 20*a* and 20*b* in FIG. 2 denote staple stackers disposed below the sheet conveying units 10D and 10E which are substituted for the offset stackers 11*a* and 11*b* shown in FIG. 1.

When performing bookbinding here in the sheet processing portion 11 provided with the staple stackers 20*a* and 20*b*, sheets are first discharged onto a processing tray 21 from the inlet roller 16, and then bumped against a stapler 22 by the paddle apparatus 17 to be aligned, after which the sheets are stapled. The stapler 22 moves next, and then the stapled sheet bundle is discharged and loaded onto the loading container 19.

Note that the above operation is performed alternately in the two staple stackers 20*a* and 20*b*. As shown in the figure, while the first staple stacker 20*a* performs stapling, the second staple stacker 20*b* is in the state in which the stapler 22 moves and the sheet bundle is discharged and loaded onto the loading container 19.

It thus becomes possible to take the sheets into the second staple stacker while the first staple stacker 20*a* performs stapling when the two staple stackers 20*a* and 20*b* are disposed in parallel as described above. Sheet processing can thus be performed without providing a sheet waiting area and without stopping the image formation operation, and reduction in productivity can be prevented.

Further, the expandability of the processing manner, the loading capacity, and the like can be improved by making it possible to perform substitutions between the offset stackers 11*a* and 11*b* and the staple stackers 20*a* and 20*b* that structure the sheet processing portions, which are the units below the sheet conveying units 10D and 10E.

Stacker exchange has been discussed up to this point as an example of exchanging units disposed below the sheet conveying units 10, but the present invention is not limited to this. The sheet feeding units and the stackers disposed below the sheet conveying units may also be exchanged with each other.

For example, expandability can be further increased in the sheet processing portion with the structure shown in FIG. 1, by removing the sheet feeding unit (inserter) apparatus 9*a* from below the sheet conveying unit 10C and attaching the stackers 11 and 20 or by performing the opposite operations.

Figure 3:
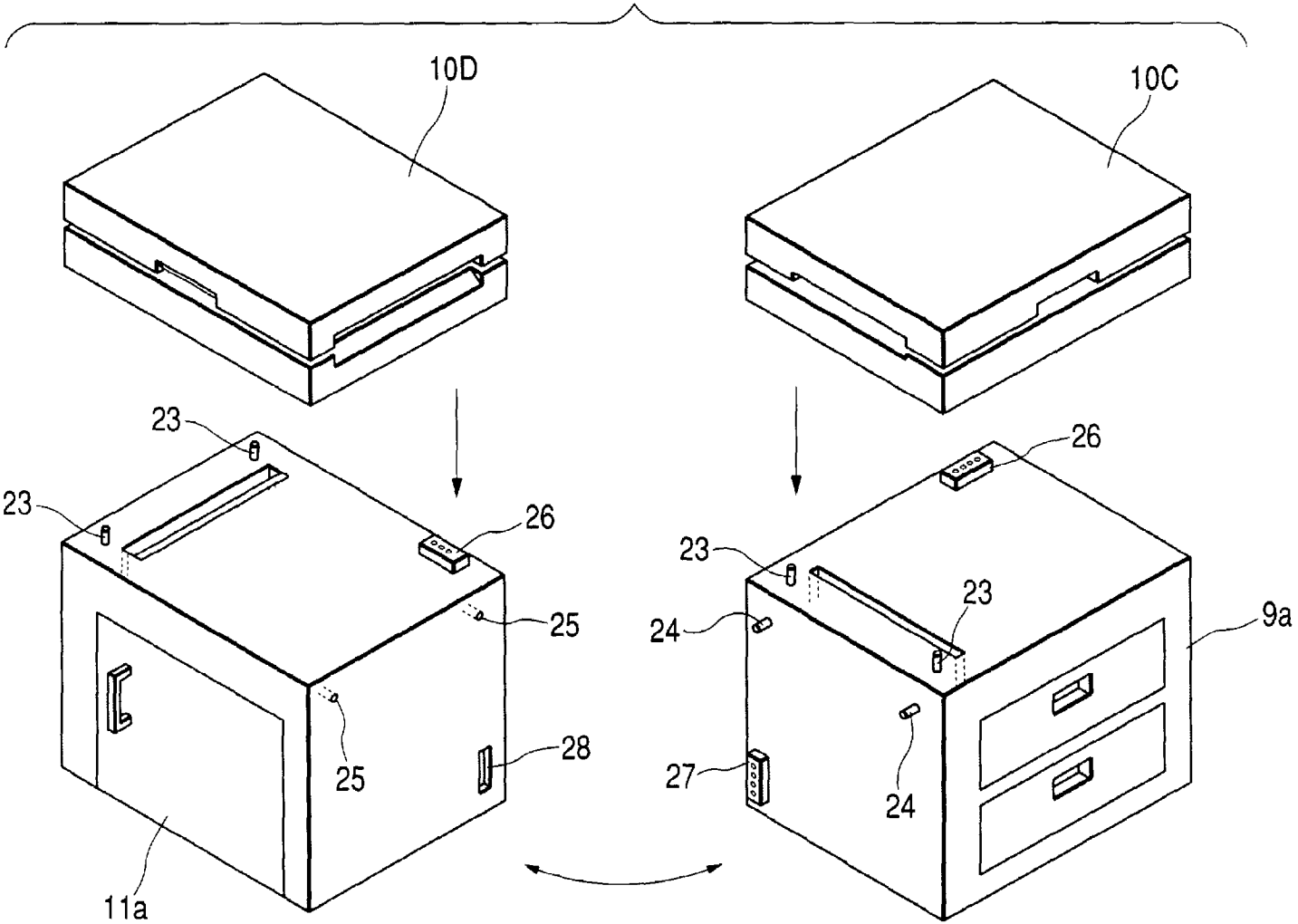
FIG. 3 is a perspective view showing an example of a method of connecting a sheet conveying apparatus that structures a sheet conveying portion of the sheet processing apparatus, and a sheet feeding apparatus and a stacker.

Note that FIG. 3 is a diagram showing an example of a method of connecting the sheet conveying units 10C and 10D with the sheet feeding unit 9*a* and the offset stacker 11*a*, respectively.

As shown in the figure, a connector 26 for connecting to electrical control signals, power sources, and the like, and pins 23 for positioning the sheet conveying units 10C or 10D, are provided on an upper surface of each of the sheet feeding unit 9*a* and the offset stacker 11*a*. A connector and engagement holes, which are not shown in the figure, are provided on a lower surface of each of the sheet conveying units 10C and 10D. The sheet feeding unit 9*a* and the offset stacker 11*a* are respectively coupled with the sheet conveying units 10C and 10D by the positioning pins 23, the not-shown engagement holes, the connectors 26, and the not-shown connectors. Similarly, connectors for connecting electrical control signals, power sources, and the like, and pins and engagement holes for positioning are provided between the sheet conveying units 10A and 10B, and the sheet feeding units 4*b* and 4*c*.

In addition, connectors 27 and 28, and pins 24 and engagement holes 25 are provided in opposing sidewall surfaces of the sheet feeding unit 9*a* and the offset stacker 11*a*, respectively. Positioning of the sheet feeding unit 9*a* and the offset stacker 11*a* is defined by the pins 24 and the engagement holes 25, and electrical connection is made by the connectors 27 and 28. Note that the disposal of the positioning pins 23 and 24 and the engagement holes 25 and the disposal of the connectors 26 and 27 are of course common throughout all of the sheet feeding units, the offset stackers, and the staple stackers.

Figure 4:
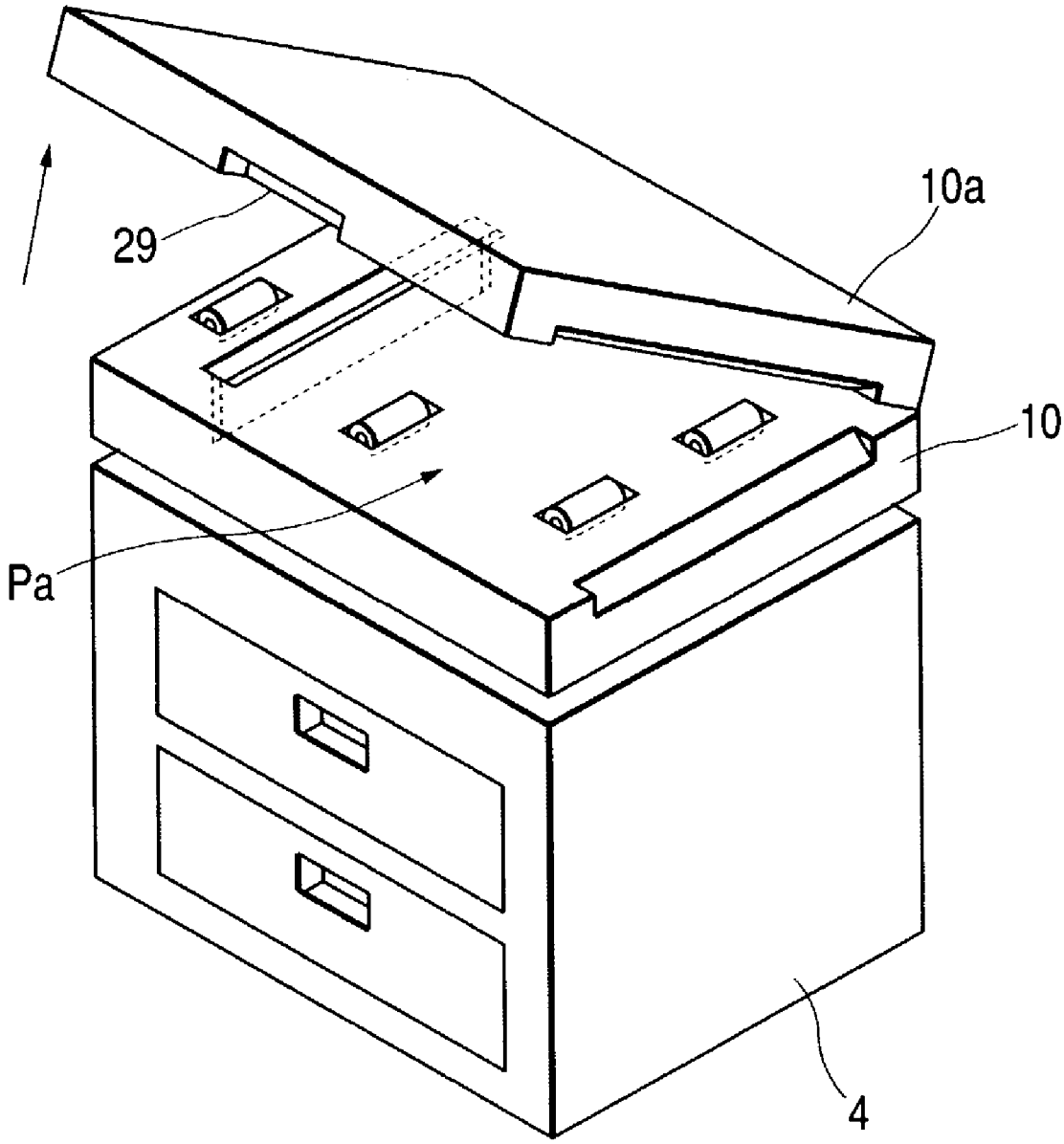
FIG. 4 is a view for explaining a jam processing of the sheet conveying apparatus.

Further, FIG. 4 is an example showing an embodiment of a jam process in the sheet conveying unit 10. Here, in the sheet conveying unit 10 disposed on the sheet feeding unit 4, an upper cover 10*a* that structures an upper surface of the sheet conveying path Pa rotates upward with the inner side as a fulcrum by pulling up a handle portion 29 on a front side. In performing the jam process, an upper side half opens around the sheet conveying path Pa when the handle portion 29 on the front side is pulled up, and therefore a jammed sheet can be easily removed.

Figure 5B:
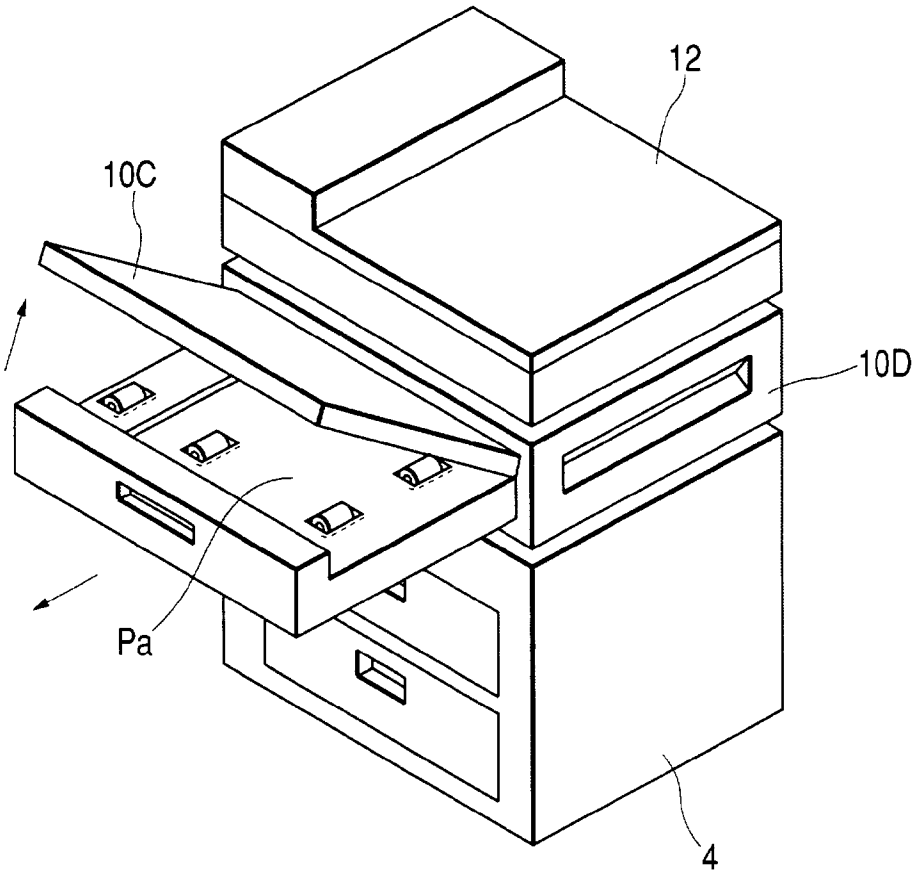
FIGS. 5A and 5B are views for explaining another jam processing of the sheet conveying apparatus.
Figure 5A:
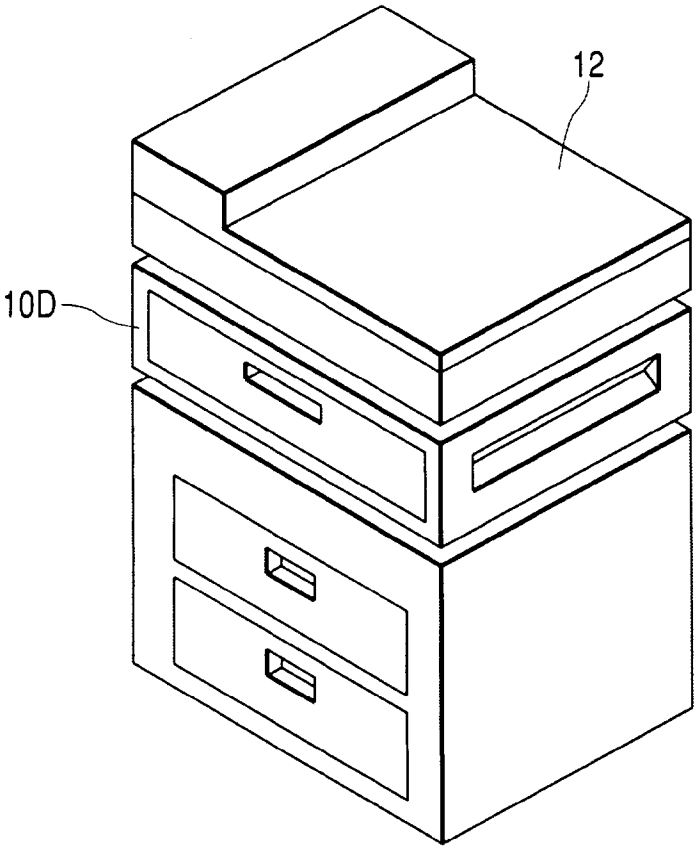

Note that for cases in which, for example, the image reading apparatus 12 is disposed on the upper surface of the sheet conveying unit 10D as shown in FIG. 1, a structure may also be used in which: a portion of the sheet conveying path Pa of the sheet conveying unit 10D is taken as a unit, and it is made possible to pull out this unit to the front side; and for cases of performing the jam process, the unit of the sheet conveying unit 10D may be temporarily pulled out to the front side from the state shown in FIG. 5A to the state shown in FIG. 5B, and then an upper portion cover 10*c* is rotated upward to open an upper half around the sheet conveying path.

A second embodiment of the present invention is explained next.

Figure 6:
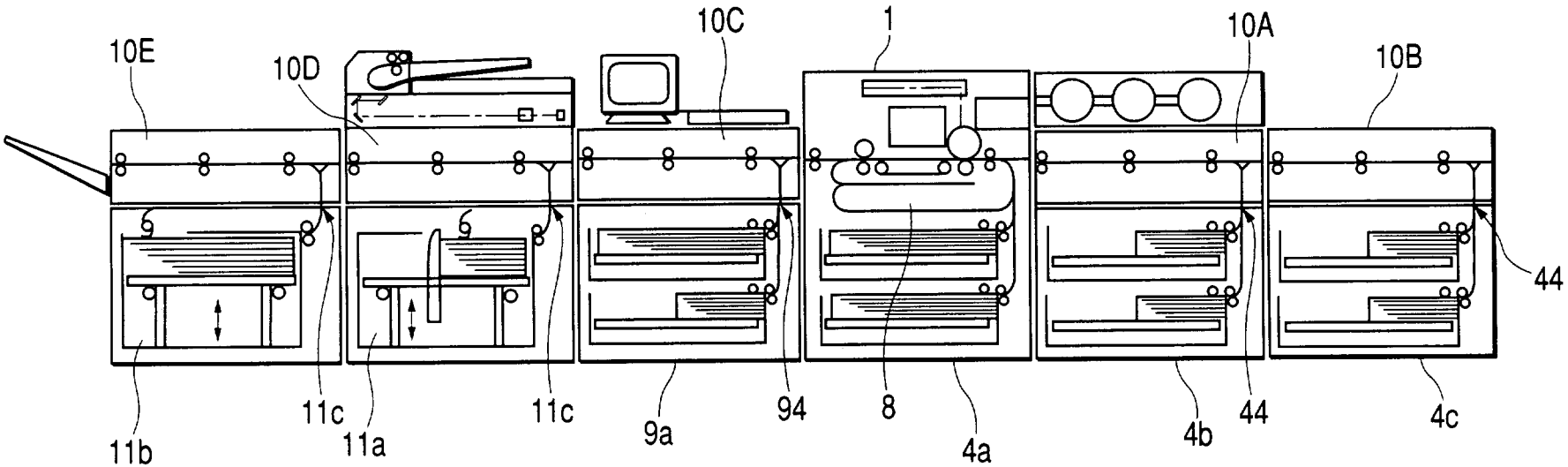
FIG. 6 is a view showing an overall structure of a sheet processing apparatus according to a second embodiment of the present invention.

FIG. 6 is a diagram showing an overall structure of a sheet processing apparatus according to this embodiment. Note that, in this figure, the same reference numerals as those in FIG. 1 show identical or corresponding portions.

In this embodiment, feeding ports 44 of the sheet feeding units 4*b* and 4*c*, a feeding port 94 of the sheet feeding unit (inserter) 9*a*, and sheet intake ports 11*c* of the offset stackers 11*a* and 11*b* are provided in the same direction, and on the right side in the figure. The sheet conveying units 10A to 10E are also correspondingly made common.

It becomes possible to make the sheet feeding units 4*b* and 4*c* and the sheet feeding unit (inserter) 9*a* common by using this type of structure. Not only can cost be reduced, but switching also becomes easy. Further, it also becomes easy to replace the offset stackers 11*a* and 11*b*, the sheet feeding units 4*b* and 4*c*, and the sheet feeding unit (inserter) 9*a*. In addition, manufacturing cost also become lower due to additional component commonality, provided that the sheet feeding apparatus 4*a* in the image forming portion 1 is separated from the image forming means 1*a* and made common with the sheet feeding units 4*b* and 4*c*.

Note that it is necessary to reverse the upper surface of the sheet on which an image is formed in the image forming portion 1, in order to perform loading in page order in the sheet processing portion 11 for cases in which image formation is performed from a leading page with this type of structure. Therefore, sheet reversal is performed for each sheet using the reversal path 8 in the image forming portion 1.

A third embodiment of the present invention is explained next.

Figure 7:
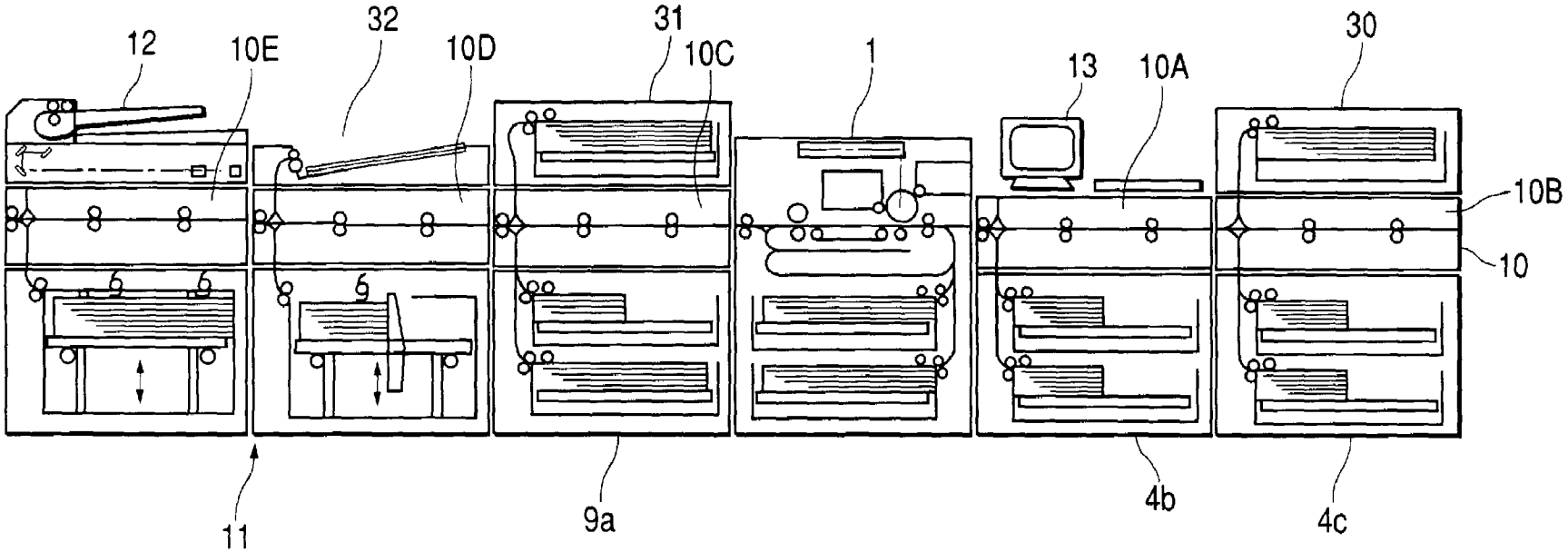
FIG. 7 is a view showing an overall structure of a sheet processing apparatus according to a third embodiment of the present invention.

FIG. 7 is a diagram showing an overall structure of a sheet processing apparatus according to this embodiment. Note that, in the figure, the same reference numerals as those in FIG. 1 show identical or corresponding portions.

In this embodiment, an inserter 31 is disposed on the sheet conveying unit 10C, a sheet feeding unit 30 is disposed on the sheet conveying unit 10B, and a sheet discharging apparatus 32 is disposed on the sheet conveying unit 10D. Note that the sheet discharging apparatus 32 is an apparatus for discharging a small number of printouts, or a sheet on which an image has been formed for a test, for example.

By thus disposing the sheet feeding unit 30, the inserter 31, and the sheet discharging apparatus 32 above the sheet conveying units 10A to 10E when desired, space above the sheet conveying units 10A to 10E is effectively utilized, and it becomes possible to increase the types of sheets used in bookbinding. Note that the versatility and the expandability can be increased by providing the sheet feeding unit 30 and the inserter 31 with the same structure. In addition, reduction in manufacturing cost can also be achieved by component commonality.

The sheet processing apparatuses each of which is provided with the image forming portion 1 have been discussed in the explanation up to this point. However, the present invention is not limited to this, and can also be applied to sheet processing apparatus not provided with the image forming portion 1.

Next, description will be made of a fourth embodiment of the present invention which corresponds to the above case.

Figure 8:
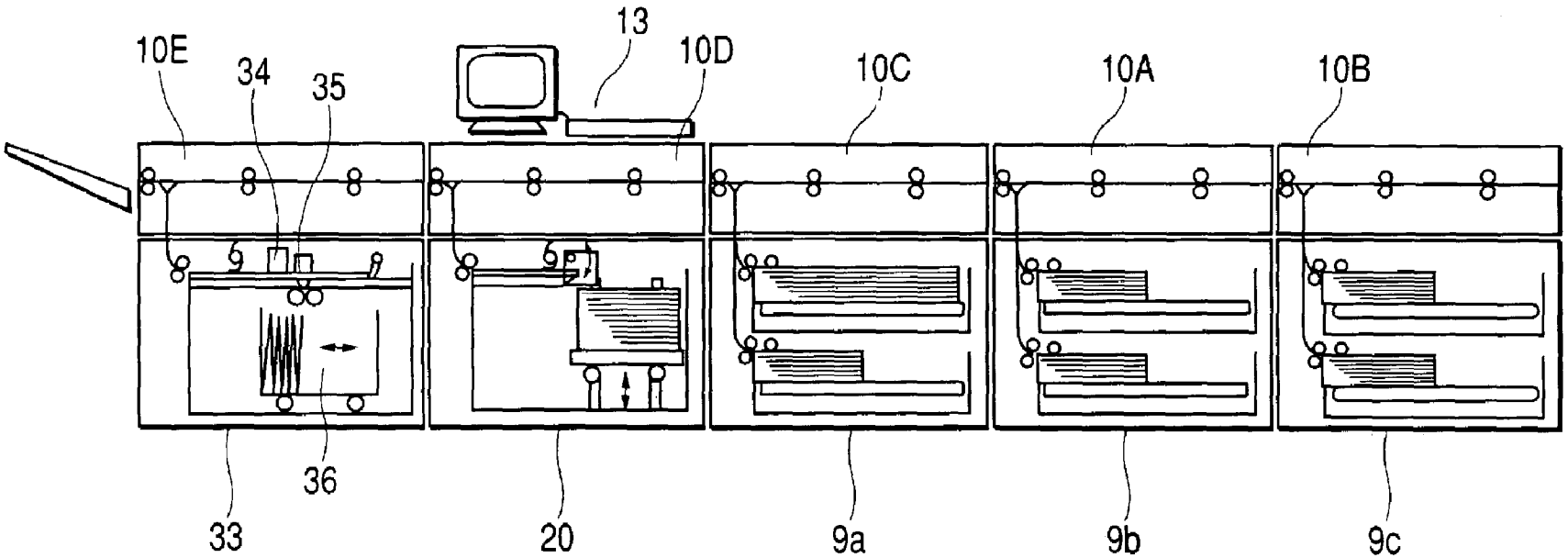
FIG. 8 is a view showing an overall structure of a sheet processing apparatus according to a fourth embodiment or the present invention.
Figure 9:
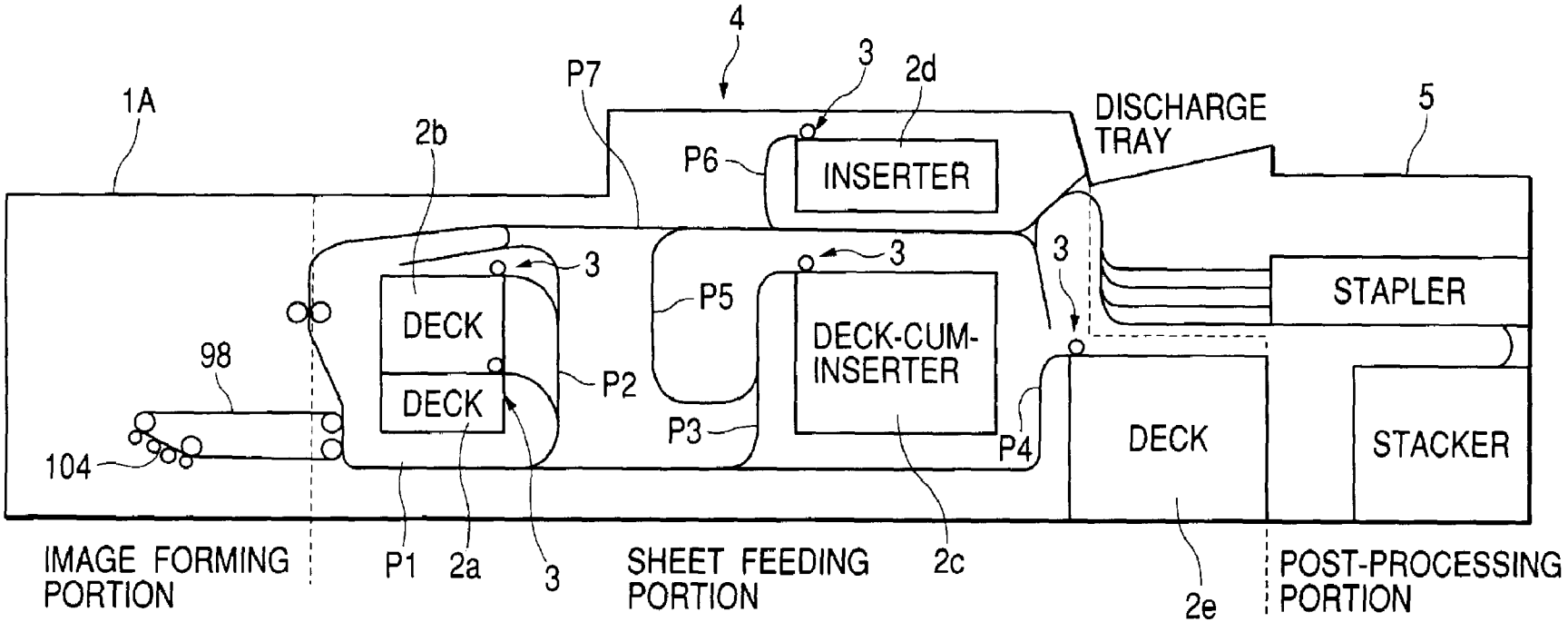
FIG. 9 is a diagram showing the structure of a conventional sheet processing apparatus.

FIG. 8 is a diagram showing an overall structure of a sheet processing apparatus according to this embodiment. Note that, in the figure, the same reference numerals as those in FIG. 1 show identical or corresponding portions.

The sheet processing apparatus in this embodiment is not provided with the image forming portion 1 and provided only with the inserter 9*a*, inserters 9*b* and 9*c*, the staple stacker 20, which structures a sheet processing portion for processing sheets sent from the inserters 9*a*, 9*b*, and 9*c*, and a center bookbinding machine 33.

The center bookbinding machine 33 is an apparatus having a structure in which: a stapler 34 performs stapling of a sheet bundle at the two central points; a folding apparatus 35 folds the central portion of the sheet bundle; and the sheet bundle is discharged to a stacker 36.

In the sheet processing apparatus having this type of structure, after sheets having images already formed thereon, or inserting paper, are set into each of the inserters 9*a*, 9*b*, and 9*c*, feeding is performed in the page order, they are relayed to the sheet conveying units 10A to 10E, and bookbinding of a sheet bundle is performed by the staple stacker 20 or the center bookbinding machine 33.

Note that although the bookbinding machine with the use of a stapler is explained in this embodiment, a bookbinding machine with the use of an adhesive or the like may also be used.

As explained above, according to the present invention, a sheet processing apparatus having good expandability in the types and volumes of sheets used, processing manner, loading capacity, and the like can be provided by making the sheet conveying portion for conveying sheets to the sheet processing portion have the structure in which plural sheet conveying units having the same structure are disposed in parallel in a rearrangeable fashion.

What is claimed is:

1. A sheet processing apparatus comprising:

a plurality of sheet processing units for processing a sheet;

a plurality of sheet feeding units for sending out a sheet; and a sheet conveying portion for conveying a sheet sent out from said sheet feeding units to the sheet processing units, wherein:

the sheet conveying portion comprises a plurality of sheet conveying units, each of said plurality of sheet conveying units has a sheet intake port, a sheet discharge port, and a linear sheet conveying path for conveying the sheet from the sheet intake port to the sheet discharge port, and said plurality of sheet conveying units are a same structure and disposed in parallel such that respective sheet conveying paths thereof are positioned on the substantially same plane and in a re-arrangeable fashion; and the sheet processing units and said sheet feeding units are each detachably attached to the sheet conveying units.

2. A sheet processing apparatus according to claim 1, wherein:

the sheet feeding unit is provided with a sheet receiving portion that receives sheets and a sheet feeding portion that sends out the sheets from the sheet receiving portion.

3. A sheet processing apparatus according to claim 1, wherein different sheet processing units are interchangeably attached to the sheet conveying units positioned downstream of the sheet conveying unit to which the sheet feeding unit is attached in accordance with a type of sheet processing.

4. A sheet processing apparatus according to claim 1, wherein the sheet processing unit is a staple stacker that binds a sheet bundle by stapes.

5. A sheet processing apparatus according to claim 1, wherein the sheet processing unit is an offset stacker in which sheets are offset and stacked for each bundle.

6. A sheet processing apparatus according to claim 1, wherein the sheet conveying unit is openable and closable around the sheet conveying path in order to open the sheet conveying path.

7. A sheet processing apparatus according to claim 1, wherein:

the sheet conveying path of the sheet conveying unit structures a unit; and the sheet conveying path unit is structured so as to be capable of being pulled out and be openable and closable around the sheet conveying path in order to open the sheet conveying path.

8. A sheet processing apparatus comprising:

a plurality of sheet processing units for processing a sheet;

a plurality of sheet feeding units for sending out a sheet;

a sheet conveying portion for conveying a sheet sent out from said feeding units to the sheet processing units;

wherein the sheet conveying portion comprises a plurality of sheet conveying units, each of said plurality of sheet conveying units has a sheet intake port, a sheet discharge port, and a linear sheet conveying path for conveying the sheet from the sheet intake port to the sheet discharge port, and said plurality of sheet conveying units are a same structure and disposed in parallel such that respective sheet conveying paths thereof are positioned on the substantially same plane and in a re-arrangeable fashion, and the sheet processing units and said sheet feeding units are each detachably attached to the sheet conveying units, and an image forming portion disposed between the sheet conveying units to which the sheet feeding unit is attached and the sheet processing unit for forming an image on a sheet fed from the sheet feeding unit.

9. A sheet processing apparatus according to claim 8, wherein:

the image forming portion comprises image forming means for forming an image on a sheet and a linear sheet conveying path for guiding the sheet so as to pass through the image forming means; and the image forming portion is arranged such that the sheet conveying path thereof is positioned on the same plane as the sheet conveying path of the sheet conveying unit.

10. A sheet processing apparatus according to claim 9, wherein an image reading apparatus is provided in the sheet conveying unit.

11. A sheet processing apparatus according to claim 8, wherein:

a sheet conveying unit having the same structure as the sheet conveying unit to which the sheet feeding unit is attached is provided between the image forming portion and the sheet processing portion; and an inserter for feeding an insertion sheet to the sheet processing portion is detachably attached to the sheet conveying unit.

12. A sheet processing apparatus according to claim 11, wherein the sheet feeding unit and the inserter have the same structure.

13. A sheet processing apparatus according to claim 8, wherein the sheet processing unit is a bookbinding portion comprising a bookbinding mechanism for performing bookbinding by bundling and binding together sheets on which images are formed by the image forming portion.

14. A sheet processing apparatus according to claim 13, wherein a sheet conveying unit having the same structure as the sheet conveying unit to which the sheet feeding unit is attached is provided between the image forming portion and the bookbinding portion, and an inserter for inserting a sheet in between sheets that are conveyed from the image forming portion is attached to the sheet conveying unit provided between the image forming portion and the bookbinding portion.

15. A sheet processing apparatus according to claim 8, wherein connecting means for establishing electrical connection is provided between the sheet conveying unit and the sheet feeding unit attached to the sheet conveying unit.

16. A sheet processing apparatus according to claim 8, wherein connecting means for establishing electrical connection is provided between adjacent units among the sheet feeding units attached to the plurality of sheet conveying units disposed in parallel.

* * * * *

UNITED STATES PATENT AND TRADEMARK OFFICE

CERTIFICATE OF CORRECTION

PATENT NO. : 7,080,830 B2
APPLICATION NO. : 10/376290
DATED : July 25, 2006
INVENTOR(S) : Toshimasa Suzuki et al.

It is certified that error appears in the above-identified patent and that said Letters Patent is hereby corrected as shown below:

COLUMN 4:
Line 45, “form” should read --from--.

COLUMN 5:
Line 21, “after” should read --after being--.

COLUMN 8:
Line 42, “cost” should read --costs--.

Signed and Sealed this

Twenty-second Day of May, 2007

JON W. DUDAS
*Director of the United States Patent and Trademark Office*